US007455198B2

(12) United States Patent
Foster et al.

(10) Patent No.: US 7,455,198 B2
(45) Date of Patent: Nov. 25, 2008

(54) TRIGGER FORWARD PIVOT LIMIT FOR A TRIGGER SPRAYER

(75) Inventors: Donald D. Foster, St. Charles, MO (US); Philip L. Nelson, Wildwood, MO (US); Walter J. Clynes, O'Fallon, MO (US)

(73) Assignee: Meadwestvaco Calmar, Inc., Grandview, MO (US)

( * ) Notice: Subject to any disclaimer, the term of this patent is extended or adjusted under 35 U.S.C. 154(b) by 0 days.

(21) Appl. No.: 11/851,827

(22) Filed: Sep. 7, 2007

(65) Prior Publication Data

US 2007/0295758 A1 Dec. 27, 2007

Related U.S. Application Data

(63) Continuation-in-part of application No. 11/369,351, filed on Mar. 7, 2006.

(51) Int. Cl.
*B67D 5/40* (2006.01)

(52) U.S. Cl. ..... 222/383.1; 222/340; 239/333

(58) Field of Classification Search ..... 222/383.1, 222/381, 382, 340; 239/333, 302, 369
See application file for complete search history.

(56) References Cited

U.S. PATENT DOCUMENTS

| | | | | | |
|---|---|---|---|---|---|
| 4,161,288 | A * | 7/1979 | McKinney | 239/333 |
| 4,503,998 | A * | 3/1985 | Martin | 222/341 |
| 4,917,303 | A * | 4/1990 | Maas et al. | 239/333 |
| 5,152,436 | A | 10/1992 | Maas et al. | |
| 5,294,025 | A | 3/1994 | Foster | |
| 5,299,717 | A | 4/1994 | Geier | |
| 5,762,236 | A * | 6/1998 | Foster et al. | 222/383.1 |
| 6,032,834 | A * | 3/2000 | Keung | 222/383.1 |
| 6,116,472 | A * | 9/2000 | Wanbaugh et al. | 222/340 |
| 6,641,003 | B1 * | 11/2003 | Foster et al. | 222/383.1 |
| 2007/0210106 | A1 * | 9/2007 | Foster | 222/153.06 |
| 2007/0210116 | A1 * | 9/2007 | Clynes et al. | 222/340 |
| 2007/0210117 | A1 * | 9/2007 | Foster et al. | 222/340 |
| 2007/0215647 | A1 * | 9/2007 | Foster et al. | 222/383.1 |
| 2007/0228187 | A1 * | 10/2007 | Nelson et al. | 239/337 |

* cited by examiner

*Primary Examiner*—Lien T Ngo

(57) ABSTRACT

A manually operated trigger sprayer includes a feature that limits the forward pivoting movement of the trigger. By limiting the forward pivoting movement of the trigger, the novel construction of the trigger sprayer prevents the trigger from engaging against the nozzle assembly attached to the sprayer housing of the trigger sprayer and potentially dislodging the nozzle assembly from its attachment to the trigger sprayer housing.

24 Claims, 11 Drawing Sheets

TRIGGER FORWARD PIVOT LIMIT FOR A TRIGGER SPRAYER

This patent application is a continuation-in-part from patent application Ser. No. 11/369,351, which was filed on Mar. 7, 2006, and is currently pending.

BACKGROUND OF THE INVENTION (1) Field of the Invention

The present invention pertains to the construction of a manually operated trigger sprayer that includes a feature that limits the forward pivoting movement of the trigger. By limiting the forward pivoting movement of the trigger, the novel construction of the trigger sprayer prevents the trigger from engaging against the nozzle assembly attached to the sprayer housing of the trigger sprayer and potentially dislodging the nozzle assembly from its attachment to the sprayer housing.

(2) Description of the Related Art

Handheld and hand pumped liquid dispensers commonly known as trigger sprayers are used to dispense many household products and commercial cleaners. Trigger sprayers have been used to dispense household cleaning or cooking liquids and have been designed to selectively dispense the liquids in a spray, stream, or foaming discharge. The trigger sprayer is typically connected to a plastic bottle that contains the liquid dispensed by the sprayer.

A typical trigger sprayer includes a sprayer housing that is connected to the neck of the bottle by either a thread connection or a bayonet-type connection. The sprayer housing is formed with a pump chamber and a vent chamber, a liquid supply passage that communicates the pump chamber with a liquid inlet opening of the sprayer housing, and a liquid discharge passage that communicates the pump chamber with a liquid outlet opening of the sprayer housing.

A dip tube is connected to the sprayer housing liquid inlet opening to communicate the pump chamber with the liquid contents of the bottle connected to the trigger sprayer. When the sprayer housing of the trigger sprayer is attached to the bottle, the dip tube is inserted through the bottle neck opening and into the liquid contained in the bottle.

A nozzle assembly is connected to the sprayer housing at the liquid outlet opening. Some nozzle assemblies include a nozzle cap that is rotatable relative to the sprayer housing between an "off" position where liquid discharge from the trigger sprayer is prevented, and one or more "on" positions where liquid discharge from the trigger sprayer is permitted. In addition, known nozzle assemblies can affect the liquid discharged by the trigger sprayer to discharge the liquid in a spray pattern, in a stream pattern, or as a foam. The typical nozzle assembly includes a tubular portion that is assembled to the sprayer housing at the liquid outlet opening of the sprayer housing. Some type of snap attachment is also usually provided on the nozzle assembly to hold the nozzle assembly to the sprayer housing. However, if a sufficient force presses against the nozzle assembly and urges the nozzle assembly away from the sprayer housing, the nozzle assembly can be dislodged from its attachment to the sprayer housing.

A pump piston is mounted in the sprayer housing pump chamber for reciprocating movement between charge and discharge positions of the piston relative to the pump chamber. When the pump piston is moved to its charge position, the piston is retracted out of the pump chamber. This creates a vacuum in the pump chamber that draws liquid from the bottle, through the dip tube and into the pump chamber. When the pump piston is moved to its discharge position, the piston is moved into the pump chamber. This compresses the fluid in the pump chamber and pumps the fluid from the pump chamber, through the liquid discharge passage of the sprayer housing and out of the trigger sprayer through the nozzle assembly.

A metal coil spring is positioned in the pump chamber and engages with the pump piston. The coil spring biases the pump piston to the discharge position of the piston.

A vent piston is often provided with the pump piston and is mounted in the vent chamber. The vent piston moves with the pump piston between a vent closed position and a vent opened position in the vent chamber. In the vent opened position, the interior volume of the bottle attached to the trigger sprayer is vented through the vent chamber to the exterior environment of the trigger sprayer. In the vent closed position, the venting path of air through the vent chamber is closed, preventing leakage of liquid in the bottle through the venting flow path should the bottle and trigger sprayer be inverted or positioned on their sides.

A trigger is mounted on the sprayer housing for movement of the trigger relative to the trigger sprayer. The trigger is operatively connected to the pump piston to cause the reciprocating movement of the pump piston in the pump chamber in response to movement of the trigger. A user's hand squeezes the trigger rearwardly toward the sprayer housing to move the trigger and move the pump piston toward discharge positions of the trigger relative to the sprayer housing and of the piston in the pump chamber. The spring in the pump chamber pushes the piston back to the charge position of the piston relative to the pump chamber when the user's squeezing force on the trigger is released.

The metal coil spring is compressed between a rear wall of the pump chamber and the pump piston when the piston is moved to the discharge position. The compressed spring pushes the pump piston back to the charge position when the user's squeezing force on the trigger is released. This movement of the pump piston toward the discharge position also moves the trigger forwardly away from the pump chamber of the sprayer housing and toward a charge position of the trigger relative to the sprayer housing. This also moves the trigger forwardly toward the nozzle assembly attached to the sprayer housing.

Inlet and outlet check valves are assembled into the respective liquid supply passage and liquid discharge passage of the trigger sprayer. The check valves control the flow of liquid from the bottle interior volume through the liquid supply passage and into the pump chamber, and then from the pump chamber and through the liquid discharge passage to the nozzle assembly of the trigger sprayer.

In the typical construction of the trigger sprayer discussed above, the positioning of the nozzle assembly on the sprayer housing requires that the forward movement of the trigger caused by the spring urging the pump piston toward the charge position be stopped before the trigger engages with the nozzle assembly. As the trigger is pivoted forwardly by the force of the spring on the pump piston, should the trigger engage with a portion of the nozzle assembly the force of the spring urging the trigger forward against the nozzle assembly could be sufficient to overcome the snap connection of the nozzle assembly to the sprayer housing. This would result in the engagement of the trigger against the portion of the nozzle assembly dislodging and pushing the nozzle assembly off of the liquid discharge opening of the sprayer housing. What is needed to overcome this problem is a novel construction of a trigger sprayer that prevents the trigger when moved forwardly by the spring from contacting the nozzle assembly.

SUMMARY OF THE INVENTION

The trigger sprayer of the present invention overcomes the potential problems caused by the trigger contacting the nozzle assembly of the trigger sprayer by providing features in the construction of the trigger sprayer that limit the forward movement of the trigger and thereby prevent the trigger from engaging with the nozzle assembly. In this way, the construction of the trigger sprayer of the invention prevents the unintended and undesirable separation of the nozzle assembly from the sprayer housing.

The trigger sprayer of the invention has a sprayer housing construction that is similar to that of prior art trigger sprayers. The sprayer housing basically includes an integral cap that attaches to the neck of a separate bottle that contains the liquid to be dispensed by the trigger sprayer. A liquid inlet opening is provided on the sprayer housing inside the cap, and a liquid supply passage extends upwardly through the sprayer housing from the liquid inlet opening.

The sprayer housing also includes a pump chamber having a cylindrical pump chamber wall. The pump chamber communicates with the liquid supply passage.

A liquid discharge passage extends through a liquid discharge tube on the sprayer housing. The liquid discharge passage communicates the pump chamber with a liquid outlet opening on the sprayer housing. The sprayer housing liquid outlet opening has a center axis that defines an axial direction that extends forwardly and rearwardly relative to the sprayer housing.

The sprayer housing also has a pair of panels that extend in the axial direction along opposite sides of the liquid discharge passage. Each of the panels is formed with a pivot surface, and with a stop surface that extends in the axial direction from the pivot surface. In one embodiment, the pivot surfaces of the panels are part of socket holes in the panels.

A valve assembly is inserted into the liquid supply passage and separates the liquid supply passage from the liquid discharge passage. The valve assembly includes an input valve that controls the flow of liquid from the sprayer housing inlet opening to the pump chamber, and an output valve that controls the flow of liquid from the pump chamber and through the liquid discharge passage to the liquid outlet opening.

A valve plug assembly is assembled into the liquid supply passage of the sprayer housing. The valve plug assembly includes a valve seat that seats against the input valve, and a vent baffle that defines a vent air flow path through the pump chamber to the interior of the bottle attached to the trigger sprayer.

A nozzle assembly is assembled to the trigger sprayer at the sprayer housing liquid outlet opening. The nozzle assembly is rotatable relative to the trigger sprayer to close the liquid flow path through the liquid discharge passage and the liquid outlet opening, and to open the liquid flow path through the liquid discharge passage and the outlet opening. The nozzle assembly has several open positions relative to the sprayer housing that enable the selective discharge of a liquid in a stream pattern, a spray pattern, and a foaming discharge.

A piston assembly is mounted in the pump chamber for reciprocating movements between charge and discharge positions of the piston assembly relative to the sprayer housing. The piston assembly includes a pump piston and a vent piston, both mounted in the pump chamber. As the pump piston moves to its charge position, the vent piston is moved to a closed position where a venting air flow path through the pump chamber and through the venting air baffle is closed. As the pump piston is moved to its discharge position, the vent piston is moved to an open position in the pump chamber. This opens the venting air flow path through the pump chamber and the venting air baffle to the interior volume of the bottle attached to the trigger sprayer.

A piston rod is operatively connected to the piston assembly and a pair of springs are formed integrally with the piston rod. The length of each string is bent in an inverted U-shaped configuration between opposite proximal and distal ends of the spring. The proximal end of each spring is connected to the piston rod. From the proximal ends, the springs extend away from the piston rod and bend in the inverted U-shaped bend over the pump chamber wall. The springs have distal ends that are connected integrally with a circular collar or ring. The ring is attached around a forward end of the pump chamber wall outside the pump chamber. The ring thereby connects the spring distal ends to the sprayer housing. The springs exert a force on the piston assembly that urges the piston assembly to move toward the charge position of the piston assembly relative to the sprayer housing.

A manually operated trigger is mounted on the sprayer housing for pivoting movement. The trigger includes a forwardly facing finger engagement surface that is positioned to be engaged by the fingers of a hand holding the trigger sprayer. The trigger has a pair of pivot posts. The posts engage against the pivot surfaces on the sprayer housing in one embodiment of the trigger sprayer, and extend into socket holes on the sprayer housing in a second embodiment of the trigger sprayer. The engagement of the pivot posts with the pivot surfaces and in the socket holes mounts the trigger for pivoting movement on the sprayer housing.

The trigger also includes a pair of tabs that project in the axial direction from the pivot posts. The pair of tabs are positioned on the trigger where the tabs engage against the stop surfaces of the sprayer housing when the trigger is moved forwardly toward the discharge position of the trigger relative to the sprayer housing, and thereby prevent further forward movement of the trigger. The pair of tabs move in an arc movement away from the stop surfaces of the sprayer housing when the trigger is moved from the charge position of the trigger to the discharge position of the trigger relative to the sprayer housing. The pair of tabs on the trigger and the pair of stop surfaces on the sprayer housing thereby limit the extent of forward movement of the trigger relative to the sprayer housing and prevent the trigger from moving forwardly and engaging with the nozzle assembly and potentially dislodging the nozzle assembly from the sprayer housing.

DESCRIPTION OF THE DRAWING FIGURES

Further features of the invention are set forth in the following detailed description of the preferred embodiment of the invention and in the drawing figures.

DETAILED DESCRIPTION OF THE PREFERRED EMBODIMENT

Figure 1:
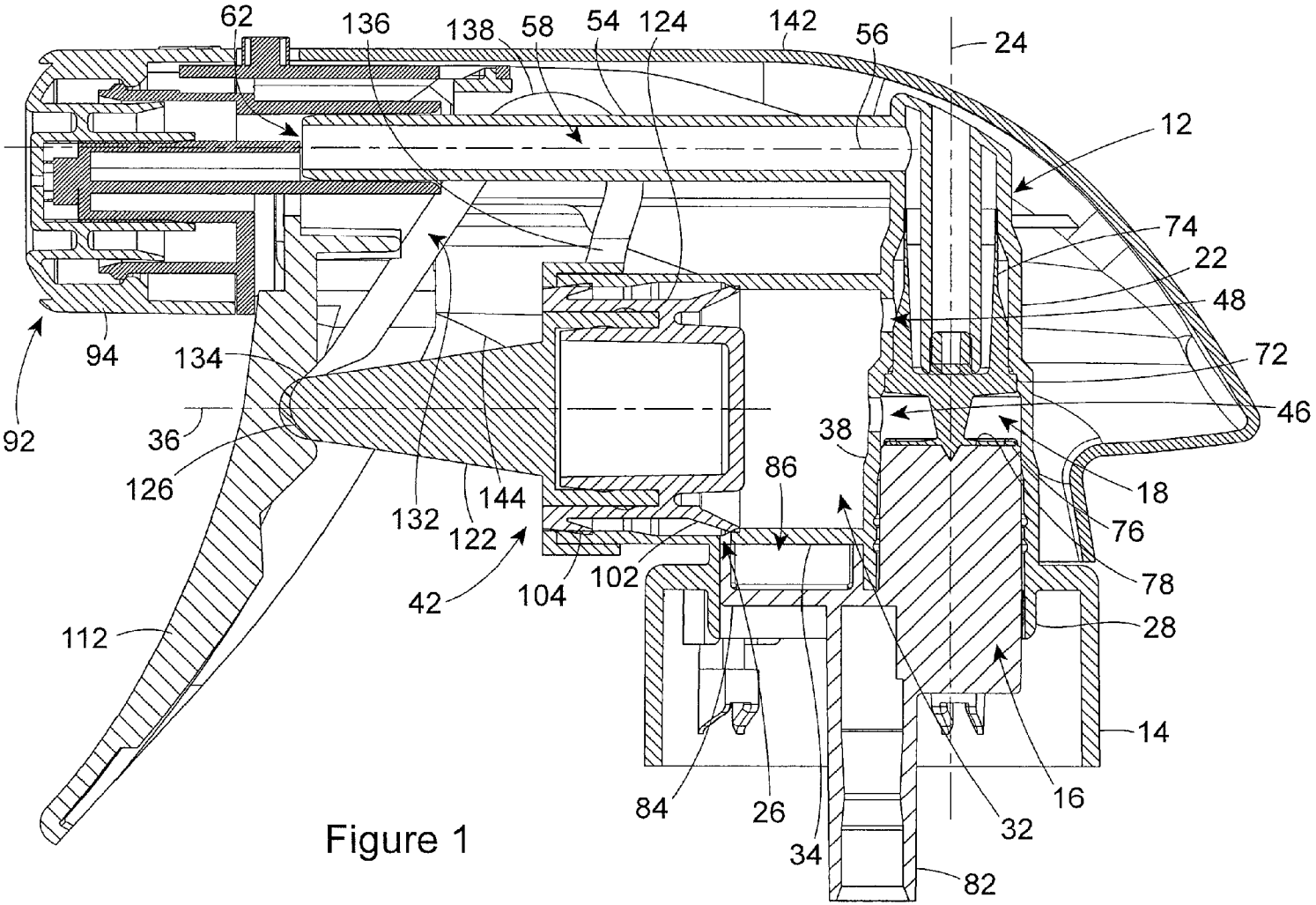
FIG. 1 is a side sectioned view of a first embodiment of the trigger sprayer of the invention with the trigger in a forward, charge position relative to the sprayer housing.

Several component parts of the trigger sprayer of the invention are found in the typical construction of a trigger sprayer, and therefore these component parts are described only generally herein. It should be understood that although the component parts are shown in the drawing figures and are described as having a certain construction, other equivalent constructions of the component parts are known. These other equivalent constructions of trigger sprayer component parts are equally well suited for use with the novel features of the invention to be described herein.

The trigger sprayer includes a sprayer housing 12 that is formed integrally with a connector cap 14. The connector cap 14 removably attaches the trigger sprayer to the neck of a bottle containing the liquid to be dispensed by the trigger sprayer. The connector cap 14 shown in the drawing figures has a bayonet-type connector on its interior. Other types of equivalent connectors may be employed in attaching the trigger sprayer to a bottle. A liquid inlet opening 16 is provided on the sprayer housing 12 in the interior of the connector cap 14. The inlet opening 16 provides access to a liquid supply passage 18 that extends upwardly through a cylindrical liquid column 22 formed in the sprayer housing 12. The column 22 has a center axis 24 that is also the center axis of the liquid supply passage 18. An air vent opening 26 is also provided on the sprayer housing 12 in the interior of the connector cap 14. A cylindrical sealing rim 28 projects outwardly from the connector cap interior and extends around the liquid inlet opening 16 and the vent opening 26. The rim 28 engages inside the neck of a bottle connected to the trigger sprayer to seal the connection.

The sprayer housing includes a pump chamber 32 contained inside a cylindrical pump chamber wall 34 on the sprayer housing 12. The pump chamber cylindrical wall 34 has a center axis 36 that is perpendicular to the liquid supply passage center axis 24. The interior surface of the pump chamber wall 34 has a smaller interior diameter section adjacent a rear wall 38 of the pump chamber, and a larger interior diameter section adjacent an end opening 42 of the pump chamber. The smaller interior diameter portion of the pump chamber 32 functions as the liquid pump chamber, and the larger interior diameter portion of the pump chamber 32 functions as a portion of a venting air flow path through the sprayer housing 12. The vent opening 26 in the sprayer housing connector cap 14 communicates the interior of the larger interior diameter portion of the pump chamber 32 with a bottle connected to the trigger sprayer. A pair of openings 46, 48 pass through the pump chamber rear wall 38 and communicate the interior of the pump chamber with the liquid supply passage 18. The first of the openings 46 is the liquid input opening to the pump chamber 32, and the second of the openings 48 is the liquid output opening from the pump chamber.

A liquid discharge tube 52 is also formed on the sprayer housing 12. The liquid discharge tube is cylindrical and has a center axis 54 that is parallel with the pump chamber center axis 36. The liquid discharge tube 52 defines the liquid discharge passage 58 of the sprayer housing. One end of the liquid discharge passage 58 communicates with the liquid supply passage 18 in the liquid column 22, and the opposite end of the liquid discharge passage 58 exits the sprayer housing 12 through a liquid outlet opening 62 on the sprayer housing.

Figure 2:
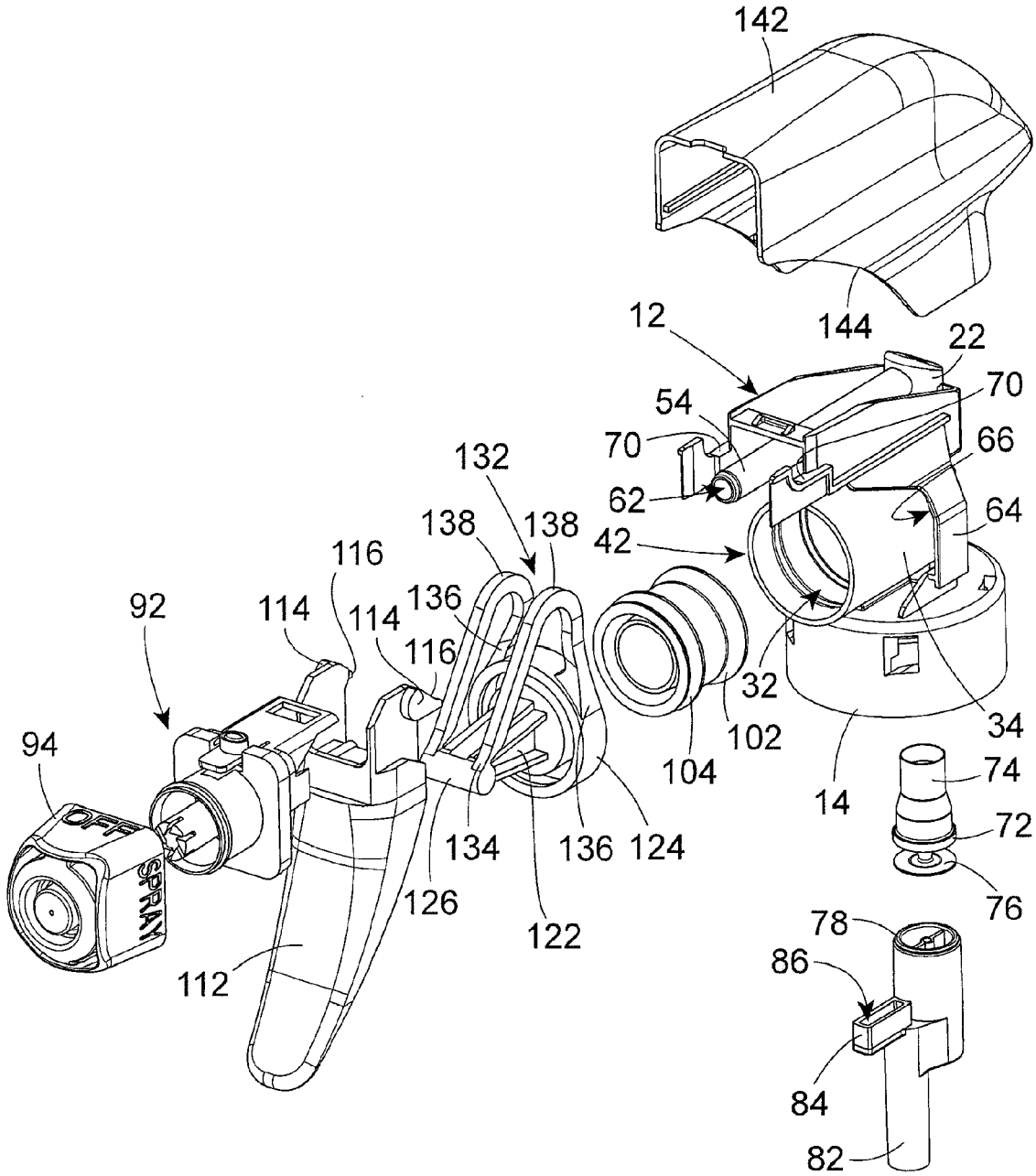
FIG. 2 is a perspective view of the disassembled component parts of the trigger sprayer of FIG. 1.
Figure 3:
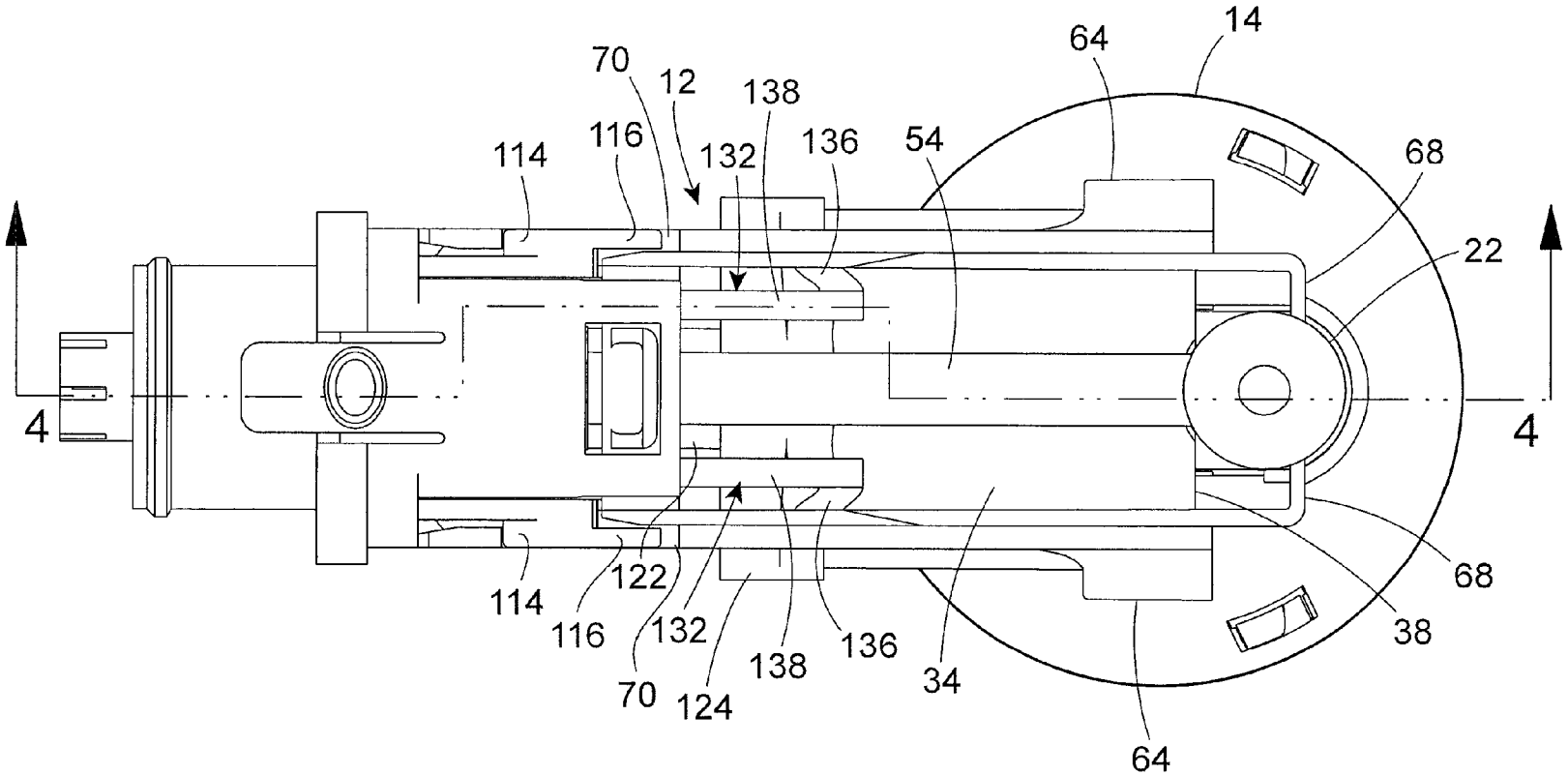
FIG. 3 is a top view of the trigger sprayer of FIG. 1 with the shroud removed.
Figure 4:
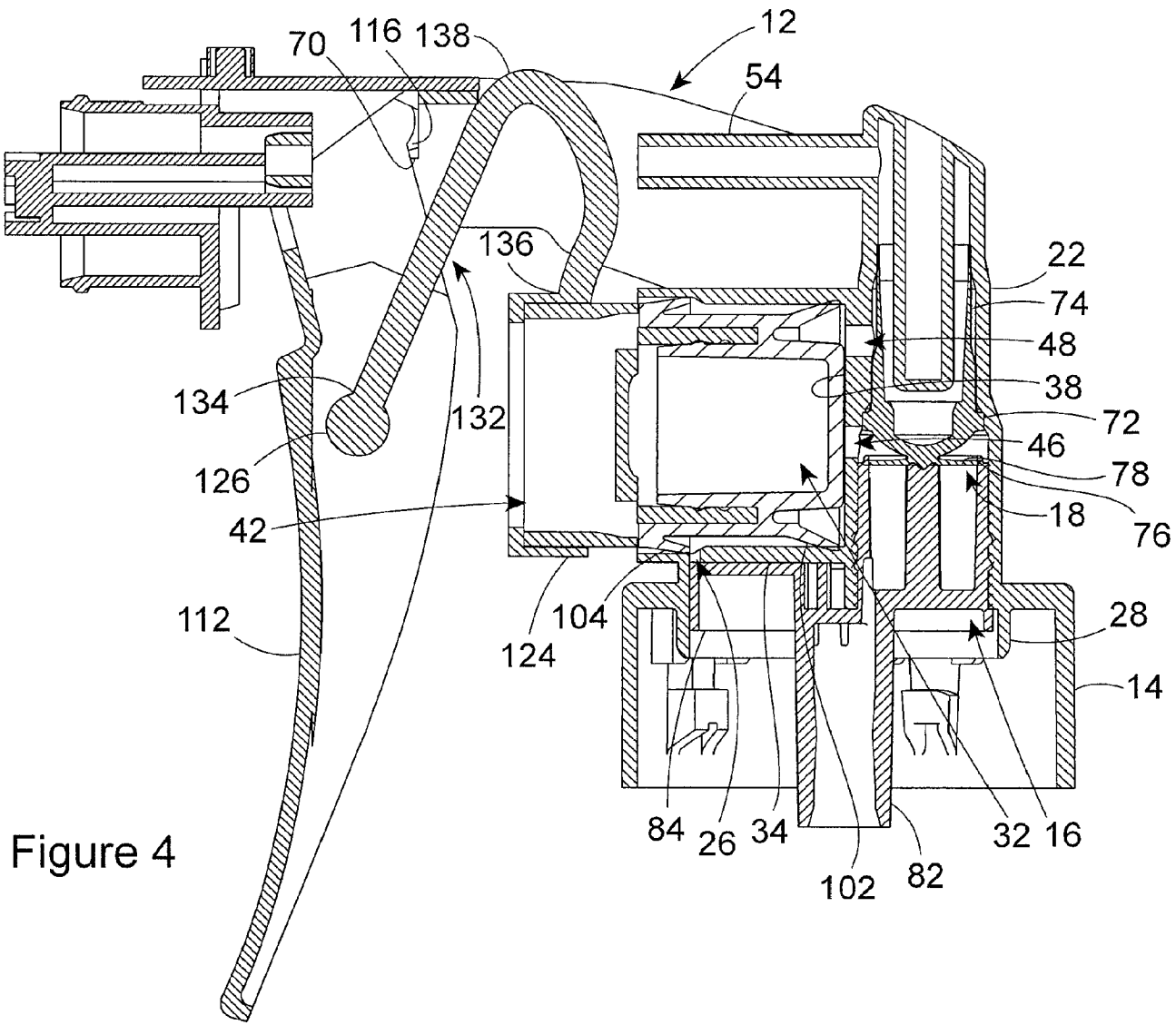
FIG. 4 is a side sectioned view of the trigger sprayer along the line 4-4 of FIG. 3 and with the trigger in a rearward, discharge position relative to the sprayer housing.
Figure 5:
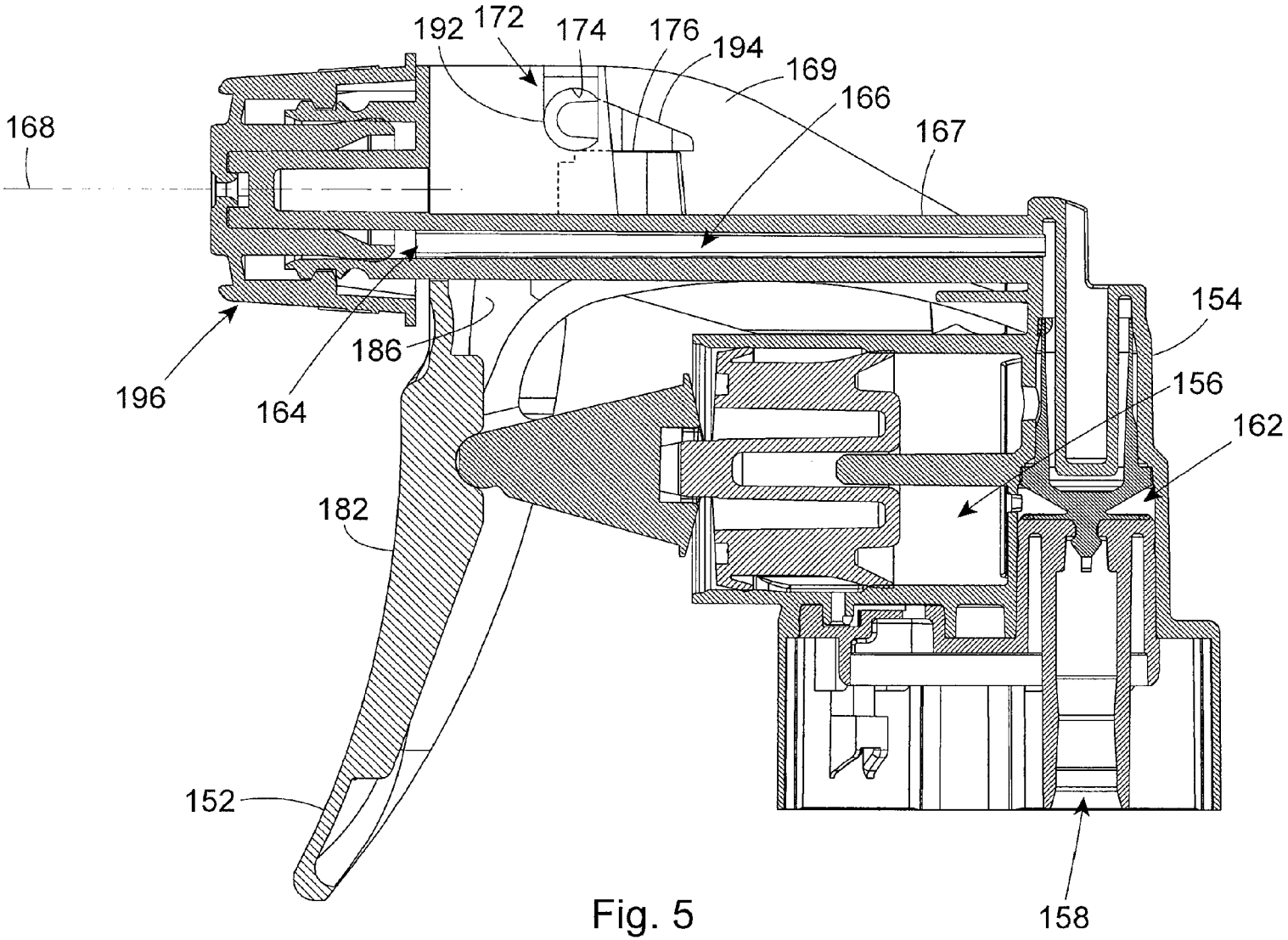
FIG. 5 is a side sectioned view of a second embodiment of the trigger sprayer of the invention with the trigger in a forward, charge position relative to the sprayer housing.
Figure 7:
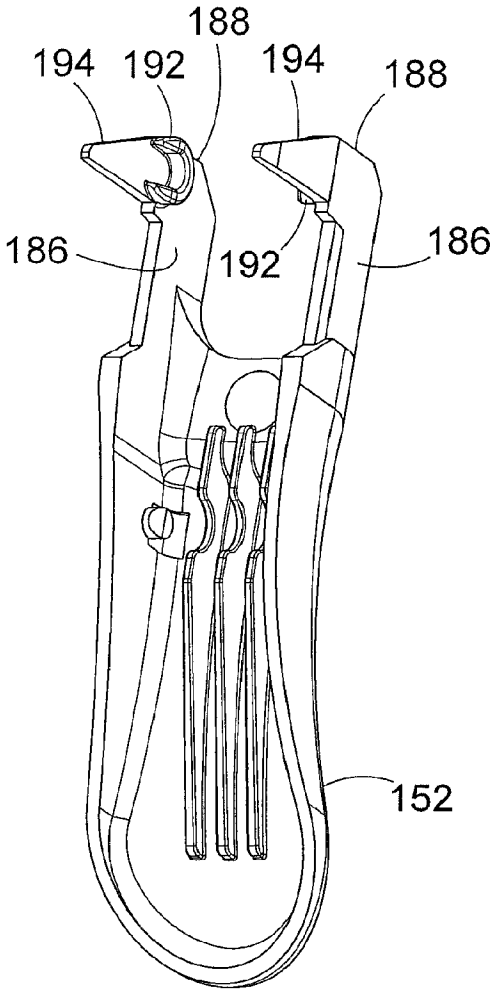
FIG. 7 is a rear perspective view of the trigger of FIG. 5.
Figure 6:
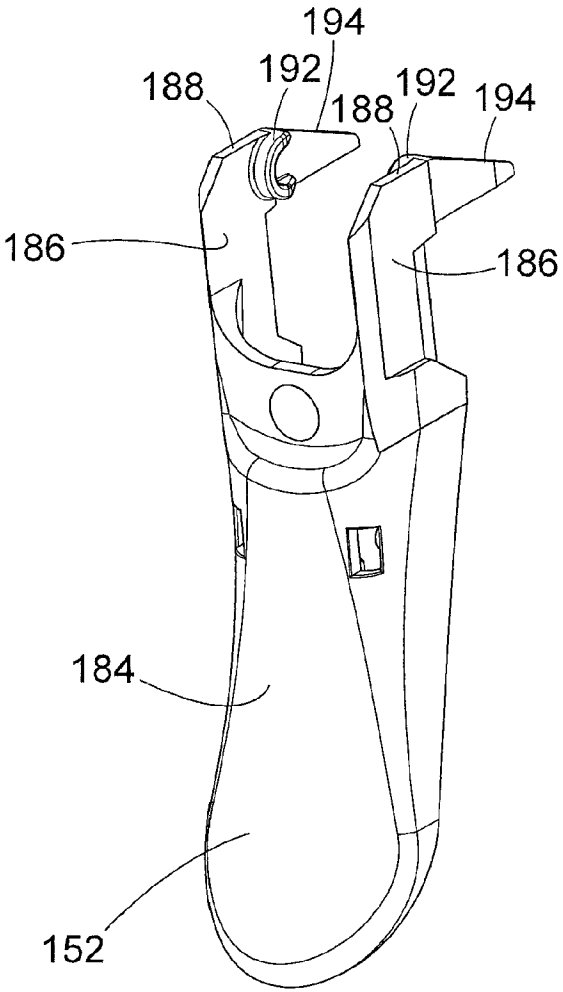
FIG. 6 is a front perspective view of the trigger of FIG. 5.
Figure 9:
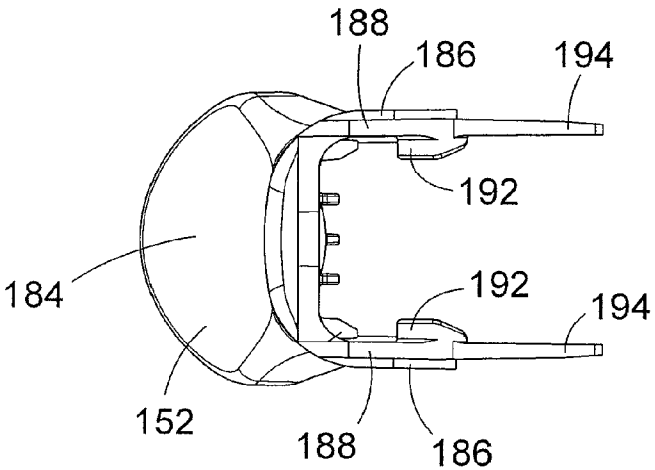
FIG. 9 is a top plan view of the trigger of FIG. 5.
Figure 8:
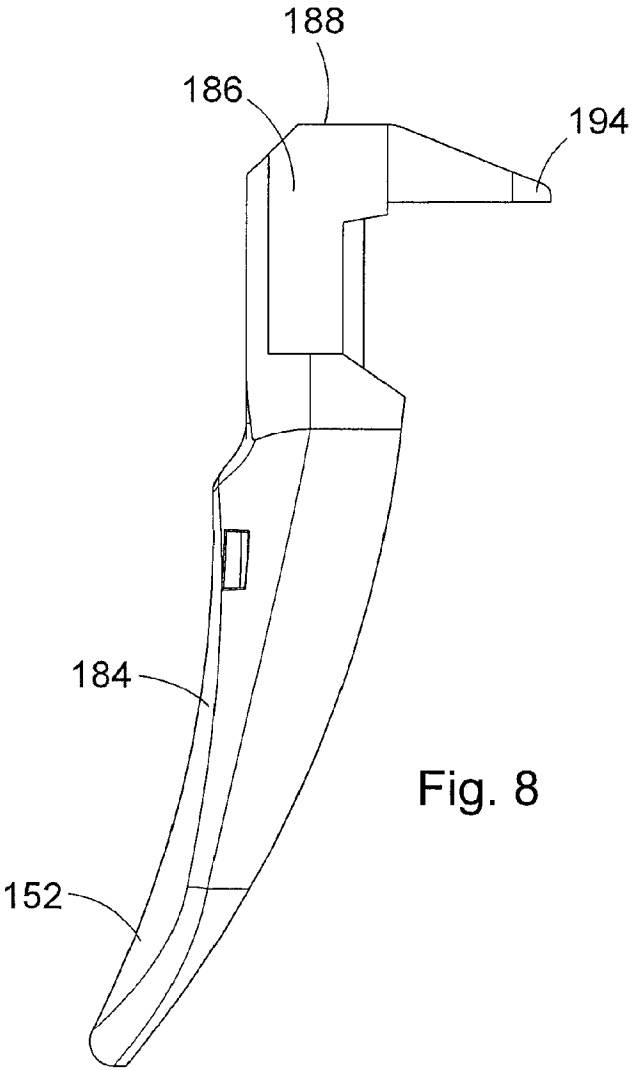
FIG. 8 is a side elevation view of the trigger of FIG. 5.
Figure 11:
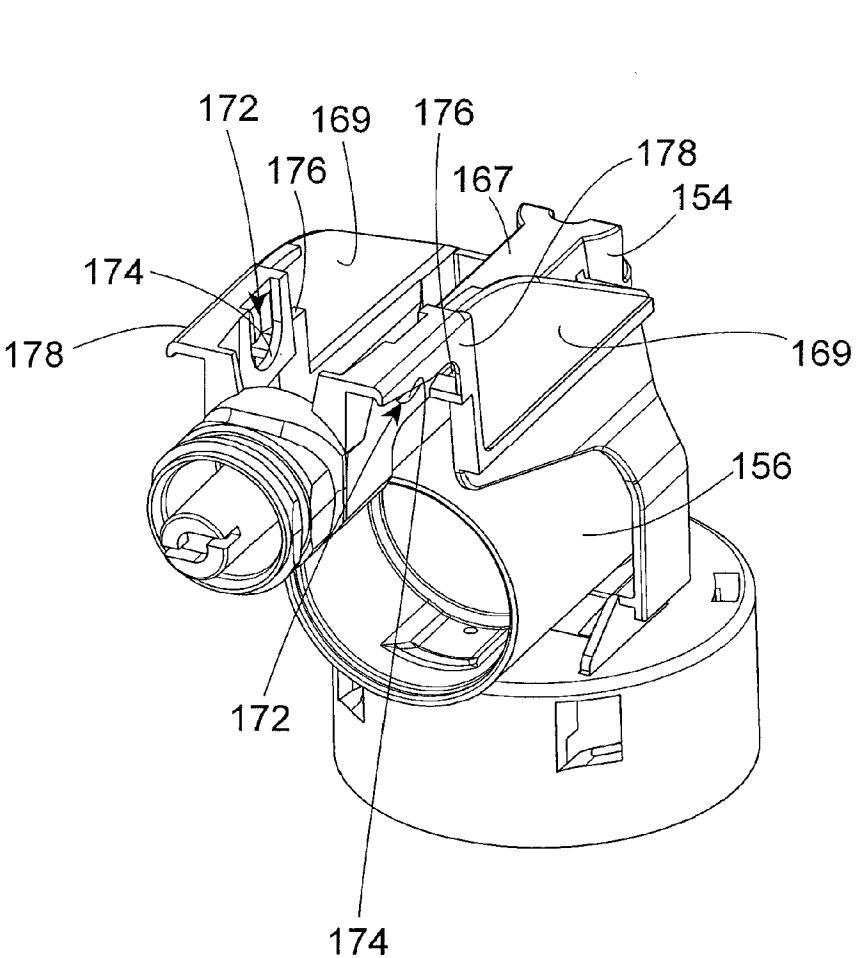
FIG. 11 is a front perspective view of the sprayer housing of the trigger sprayer shown in FIG. 5.
Figure 10:
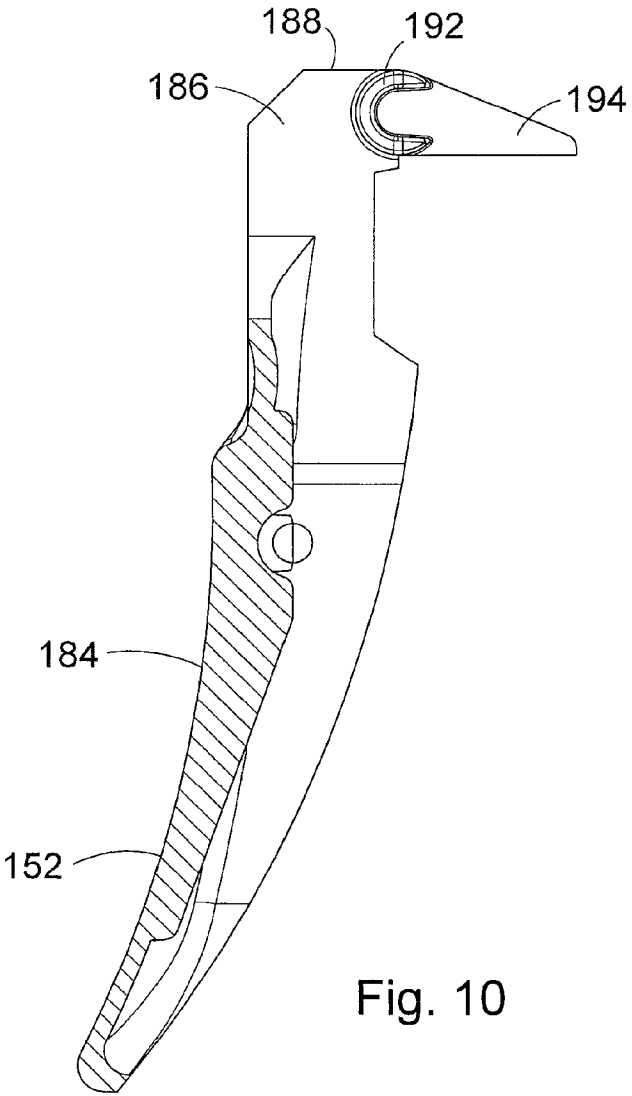
FIG. 10 is a side sectioned view of the trigger of FIG. 5.
Figure 13:
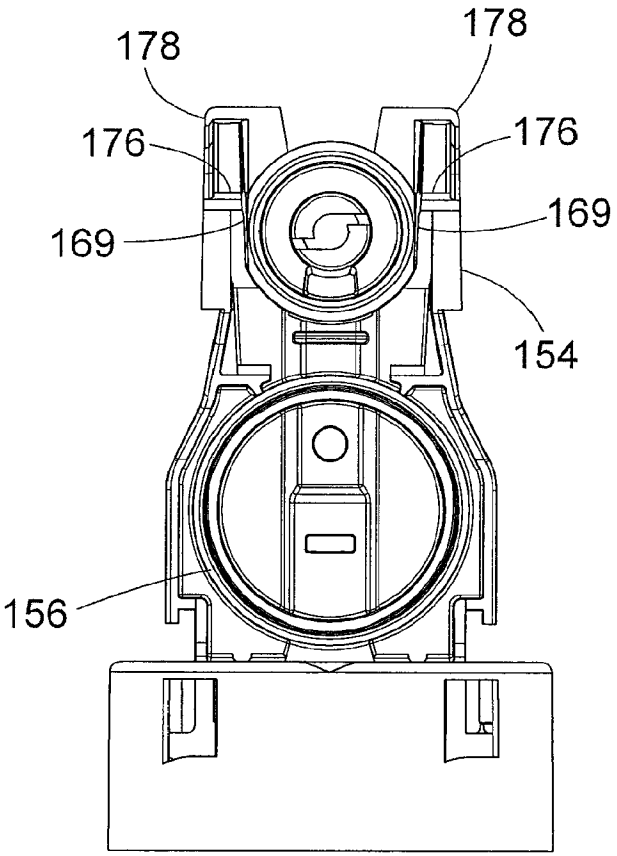
FIG. 13 is a front elevation view of the sprayer housing shown in FIG. 11.
Figure 12:
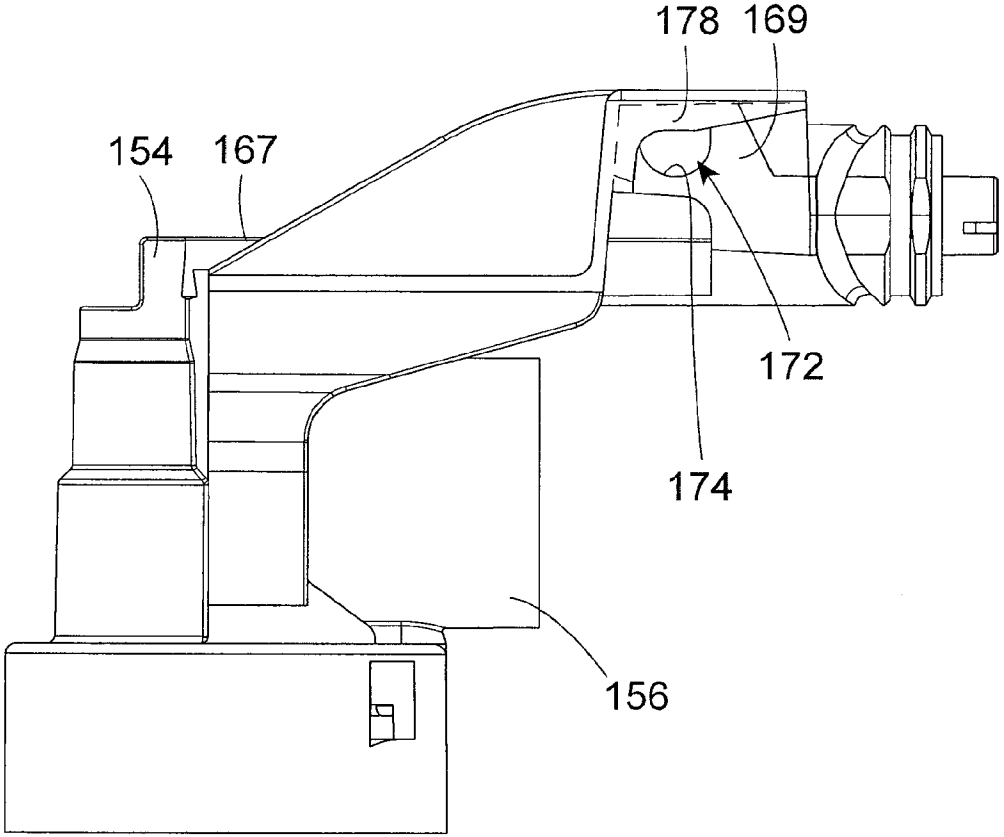
FIG. 12 is a side elevation view of the sprayer housing shown in FIG. 11.
Figure 14:
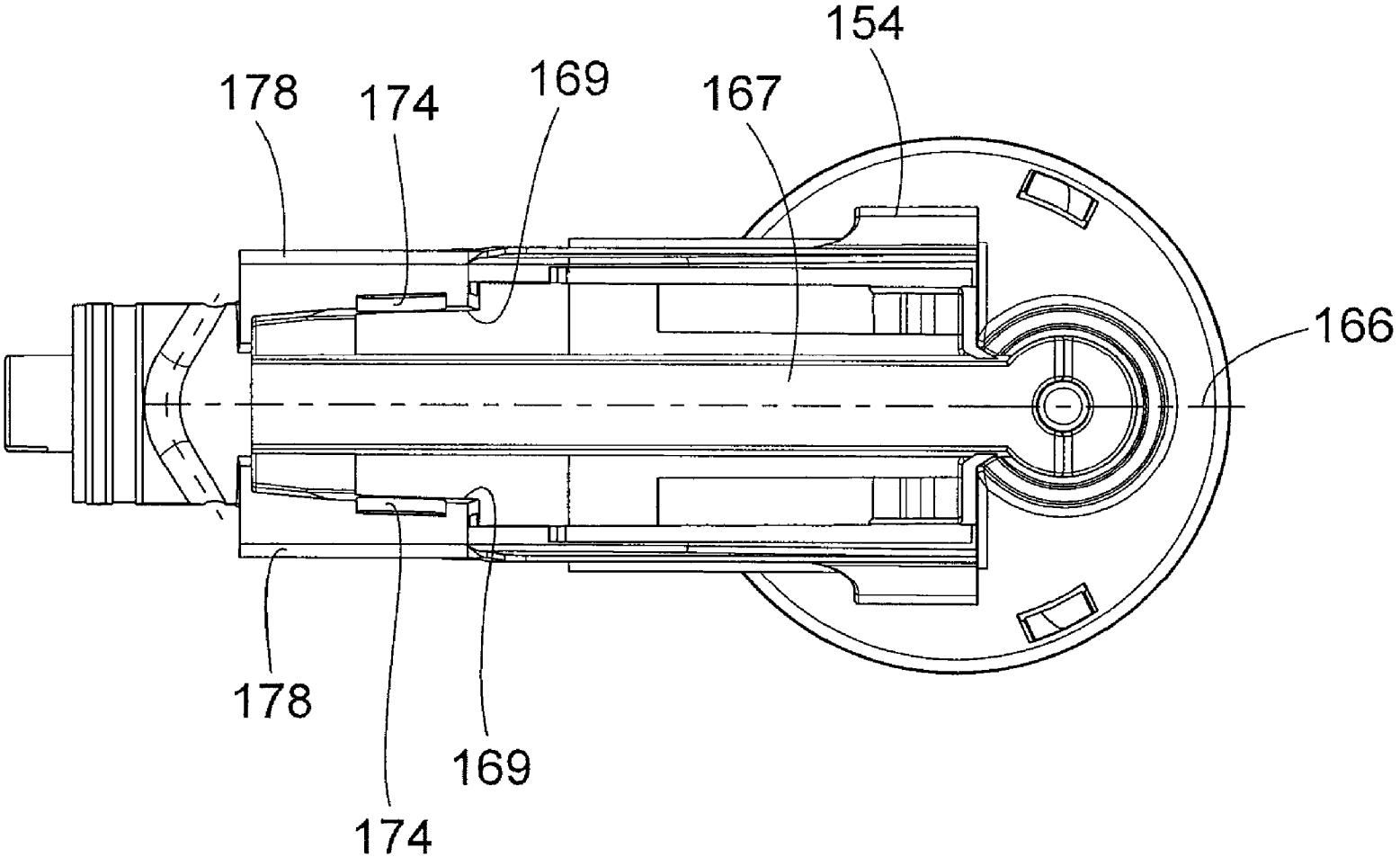
FIG. 14 is a top plan view of the sprayer housing shown in FIG. 11.
Figure 16:
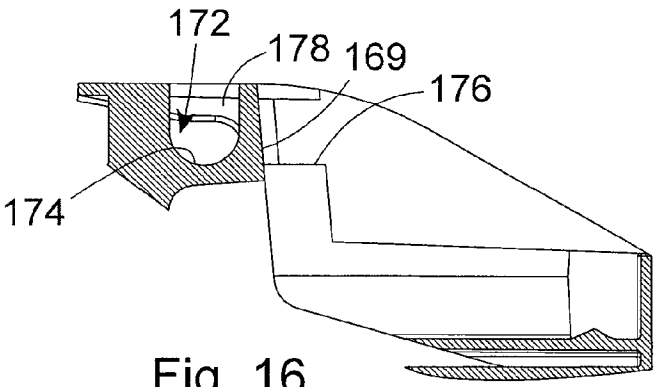
FIG. 16 is a partially sectioned side view of the sprayer housing shown in FIG. 11.
Figure 15:
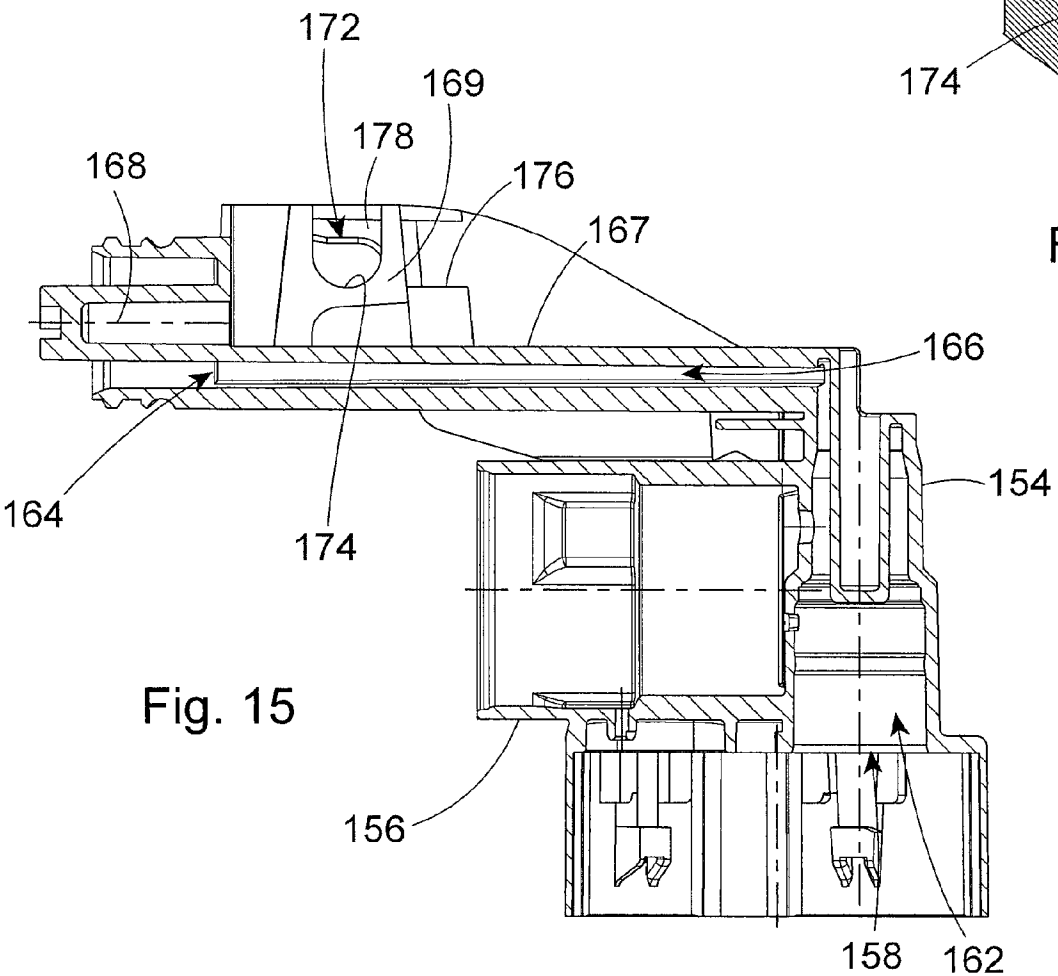
FIG. 15 is a partially sectioned side view of the sprayer housing shown in FIG. 11.

The sprayer housing 12 is also formed with a pair of exterior side walls or side panels 64 that extend over opposite sides of the pump chamber wall 34 and over opposite sides of the discharge tube 54. The side walls 64 extend over the pump chamber wall 34 in the area of the pump chamber rear wall 38, but do not extend in the forward direction the full extent of the pump chamber wall 34 to the end opening 42. The side walls 64 are spaced outwardly from the pump chamber wall 34 and the discharge tube 54 forming voids 66 between the side wall 64 and the pump chamber wall 34 and the discharge tube 54. The side walls 64 have lengths on the opposite sides of the liquid discharge tube 54 that extend substantially the entire length of the discharge tube. A pair of pivot surfaces 70 are provided on the forward ends of the side walls 64. As seen in FIG. 2, the pair of pivot surfaces 70 are positioned on opposite sides of the liquid discharge tube 54. Rear walls 68 of the sprayer housing 12 extend outwardly from opposite sides of the liquid column 22 and connect to the rearward edges of the side walls 64.

A valve assembly comprising an intermediate plug 72, a resilient sleeve valve 74 and a resilient disk valve 76 is assembled into the liquid supply passage 18. The valve assembly is inserted through the liquid inlet opening 16 and the valve assembly plug 72 seats tightly in the liquid supply passage 18 between the pump chamber input opening 46 and the pump chamber output opening 48. Thus, the plug 72 separates the liquid inlet opening 16 into the pump chamber 32 from the liquid outlet opening 62 from the pump chamber 32. The disk valve 76 is positioned in the liquid supply passage 18 to control the flow of liquid from the liquid inlet opening 16 into the pump chamber 32, and to prevent the reverse flow of liquid. The sleeve valve 74 is positioned to control the flow of liquid from the pump chamber 32 and through the liquid discharge passage 58 and the liquid outlet opening 62, and to prevent the reverse flow of liquid.

A valve plug assembly comprising a valve seat 78, a dip tube connector 82, and an air vent baffle 84 is assembled into the liquid inlet opening 16 inside the connector cap 14. The valve seat 78 is cylindrical and seats against the outer perimeter of the valve assembly disk valve 76. A hollow interior bore of the valve seat 78 allows liquid to flow through the bore and unseat the disk valve 76 from the seat 78 as the liquid flows from the inlet opening 16 to the pump chamber 32. The periphery of the disk valve 76 seats against the valve seat 78 to prevent the reverse flow of liquid. The dip tube connector 82 is a cylindrical connector at the center of the plug assembly that connects to a separate dip tube (not shown). The valve plug assembly positions the dip tube connector 82 so that it is centered in the connector cap 14 of the sprayer housing. The air vent baffle 84 covers over but is spaced from the vent opening 26 in the connector cap 14. The baffle 84 has a baffle opening 86 that is not aligned with the vent opening 26, but communicates with the vent opening through the spacing between the air vent baffle 84 and the interior surface of the connector cap 14. This allows air to pass through the vent opening 26 and through the baffle spacing and the baffle opening 86 to vent the interior of the bottle connected to the trigger sprayer to the exterior environment of the sprayer. Because the vent opening 26 and baffle opening 86 are not directly aligned, the air vent baffle 84 prevents liquid in the bottle from inadvertently passing through the baffle opening 86, the baffle spacing and the vent opening 26 to the exterior of the trigger sprayer should the trigger sprayer and bottle be inverted or positioned on their sides.

A nozzle assembly 92 is assembled to the sprayer housing 12 at the liquid outlet opening 62. The nozzle assembly 92 can have the construction of any conventional known nozzle assembly that produces the desired discharge pattern of liquid from the trigger sprayer. In the preferred embodiment of the invention, the nozzle assembly 92 has a rotatable nozzle cap 94 that selectively changes the discharge from a "off" condition where the discharge is prevented, to a "spray" condition, a "stream" condition and/or a foaming discharge. The nozzle assembly also has a tube 96 that attaches over the end of the liquid discharge tube 54. This enables the liquid discharge tube 54 to have a smaller cross-sectional diameter dimension that increases the rate of liquid flow through the liquid discharge tube 54 and exiting the tube.

A piston assembly comprising a liquid pump piston 102 and a vent piston 104 is mounted in the pump chamber 32 for reciprocating movement along the pump chamber axis 36. The pump piston 102 reciprocates between a charge position and a discharge position in the pump chamber 32. In the charge position, the pump piston 102 moves in a forward direction away from the pump chamber rear wall 38. This expands the interior of the pump chamber creating a vacuum in the chamber that draws liquid into the pump chamber, as is conventional. In the discharge position, the pump piston 102 moves in an opposite rearward direction into the pump chamber toward the pump chamber rear wall 38. This compresses the liquid drawn into the pump chamber 32 and forces the liquid through the output opening 48, past the sleeve valve 74 and through the liquid discharge passage 58 and the liquid outlet opening 62. As the pump piston 102 reciprocates in the pump chamber 32 between the charge and discharge positions, the vent piston 104 reciprocates between a vent closed position where the vent piston 102 engages against the interior surface of the pump chamber wall 34, and a vent open position where the vent piston 104 is spaced inwardly from the interior of the pump chamber wall 34. In the vent open position of the vent piston 104, air from the exterior environment of the sprayer can pass through the pump chamber opening 42, past the vent piston 104 to the vent opening 26, and then through the spacing between the baffle 84 and the connector cap 14, through the vent baffle opening 86 and to the interior of the bottle connected to the trigger sprayer.

A manually operated trigger 112 is mounted on the sprayer housing 12 for movement of the trigger relative to the sprayer housing. The trigger 112 has a pair of pivot posts 114 that project from opposite sides of the trigger. The posts 114 engage in a sliding contact with the pivot surfaces 70 on the sprayer housing and thereby mount the trigger to the sprayer housing 12 for pivoting movement. A pair of tab abutments 116 project outwardly from the pivot posts 114 limit the pivoting movement of the trigger 112 toward the sprayer housing 12. The tab abutments 116 are positioned to engage against the sprayer housing pivot surfaces 70 in the forwardmost position of the trigger 112 relative to the sprayer housing. In this way the pivot surfaces 70 function as stop surfaces that prevent any further forward pivoting movement of the trigger 112. The construction of the trigger includes a finger engagement surface that is engaged by the fingers of a user's hand. Squeezing the trigger causes the trigger to pivot rearwardly toward the pump chamber 32, and releasing the squeezing force on the trigger allows the trigger to pivot forwardly away from the pump chamber.

The novel construction of the trigger sprayer of the invention includes a piston rod 122 that is operatively connected between the trigger 112 and the pump piston 102 and vent piston 104. The piston rod 122 has a length with a annular collar or ring 124 at one end of the rod length. The ring 124 is assembled to the pump chamber 32 around the chamber end opening 42. The opposite end 126 of the piston rod 122 engages with and is operatively connected to the trigger 112.

The novel construction of the trigger sprayer also includes a pair of springs 132 that are formed integrally with the piston rod 122 and the ring 124. Together the springs 132, the piston rod 122, and the ring 124 are one, monolithic piece of plastic material, thereby reducing the number of separate component parts that go into the construction of the trigger sprayer. The pair of springs 132 each have a narrow, elongate length that extends between opposite proximal 134 and distal 136 ends of the springs. The intermediate portions 138 of the springs between the proximal ends 134 and distal ends 136 have the same bent or inverted U-shaped configurations. The spring proximal ends 134 are connected to the piston rod 122 at the first end or forward end 126 of the piston rod. From the proximal ends 134, the lengths of the springs angle upwardly away from the piston rod 22 and the pump chamber center axis 36 and then extend through the intermediate portions 138 of the springs. As the lengths of the springs extend through their U-shaped intermediate portions 138, the springs extend along opposite sides of the liquid discharge tube 154 and over the pump chamber wall 34. The springs then extend downwardly toward the pump chamber center axis 36 as the springs extend to their distal ends 136 connected to the ring 124. The ring is attached around the pump chamber 32 at the end opening 42 and thereby connects the spring distal ends 136 to the sprayer housing 12.

The inverted, U-shaped configurations of the springs 132 bias the piston rod 122 and the connected pump piston 102 and vent piston 104 outwardly away from the pump chamber rear wall 38. This biases the pump piston 102 toward its charge position relative to the pump chamber 32 and the sprayer housing 12. By manually squeezing the trigger 112, the spring proximal ends 134 move toward the spring distal ends 136, narrowing the U-shaped bend in the intermediate portions 138 of the springs. When the squeezing force on the trigger 112 is removed, the resiliency of the springs pushes the trigger 112 away from the pump chamber rear wall 38 and moves the pump piston 102 back to its charge position relative to the pump chamber 32.

A shroud 142 is attached over the sprayer housing 12 to provide an aesthetically pleasing appearance to the trigger sprayer. The shroud 142 has a lower edge 144 that is positioned below the U-shaped bends in the pair of springs 132. Thus, the shroud 142 protects the springs 132 from contact with portions of the hand or other objects exterior to the trigger sprayer when the trigger sprayer is being operated.

FIGS. 5-16 show a further embodiment of the trigger sprayer apparatus of the invention. Many of the component parts of the trigger sprayer embodiment shown in FIGS. 5-16 are substantially the same as those of the embodiment shown in FIGS. 1-4 and described above. Therefore, these same component parts will not be further described.

The embodiment of the trigger sprayer shown in FIGS. 5-16 differs from the earlier described embodiment in the construction of the pivoting connection between the trigger 152 and the sprayer housing 154.

Referring to FIGS. 5 and 11-16, the sprayer housing 154 comprises a pump chamber 156, a liquid inlet opening 158, a liquid supply passage 162 that communicates the liquid inlet opening 158 with the pump chamber 156, a liquid outlet opening 164 and a liquid discharge passage 166 that communicates the liquid outlet opening with the pump chamber 156. Except for the liquid discharge passage 166, these are all basically the same as those of the embodiment of FIG. 1. The liquid discharge passage 166 extends through a liquid discharge tube 167 of the sprayer housing 154. The discharge tube has a reduced cross-sectional area which reduces the cross sectional area of the liquid discharge passage 166. The reduced cross-sectional area of the liquid discharge passage 166 increases the velocity of liquid flow and the force of liquid ejected from the liquid outlet opening 164 over that of prior art trigger sprayers. The liquid outlet opening 164 has a center axis 168 that defines an axial direction relative to the sprayer housing 154. The axial direction extends forwardly to the left in FIG. 5 and rearwardly to the right in FIG. 5.

The sprayer housing 154 also has a pair of side walls 169 that are similar to those of the previously described embodiment. However, each of the sprayer housing side walls 169 has a socket hole 172. The socket holes 172 are each partially defined by pivot surfaces 174 that are similar to the pivot surfaces 70 of the earlier described sprayer housing.

The sprayer housing 154 is also formed with a pair of stop surfaces 176 on the sprayer housing side walls 169. The stop surfaces 176 are positioned on the side walls 169 outside of the pivot surfaces 174 that define the socket holes 172. Both the stop surfaces 176 extend in the axial direction rearwardly from the pivot surfaces 174 of the socket holes 172 on opposite sides of the liquid outlet opening center axis 168.

The sprayer housing 154 is also formed with a pair of exterior flanges 178. The pair of exterior flanges 178 are positioned on the sprayer housing 154 outside of the pair of stop surfaces 176 and outside the pair of pivot surfaces 174. Thus, there is a spacing between the sprayer housing side walls 169 that contain the socket holes 172 and the exterior flanges 178. This spacing is occupied by the stop surfaces 176.

The trigger 152 of the embodiment shown in FIGS. 5-16 has a forwardly directed finger engagement surface 184. A pair of spaced arms 186 project upwardly from the trigger finger engagement surface 184. The arms 136 extend across opposite sides of the sprayer housing liquid discharge tube 167. The arms 186 project from the trigger finger engagement surface 184 to distal ends 188 of the arms that are positioned above the liquid discharge tube 167. The arm distal ends 188 are also positioned between the sprayer housing side walls 169 and the sprayer housing exterior flanges 178.

Pivot posts 192 are provided on the arm distal ends 188. The pivot posts 192 project from the arm distal ends 188 toward each other and into the spacing between the pair of arms 186. The pivot posts 192 engage in a sliding contact with the pivot surfaces 174 of the sprayer housing 154 and thereby mount the trigger 152 to the sprayer housing 154 for pivoting movement of the trigger between a forward, charge position of the trigger relative to the sprayer housing and a rearward, discharge position of the trigger relative to the sprayer housing. The trigger 152 is also formed with a pair of abutments or tabs 194 that project from the pivot posts in the axial direction rearwardly from the trigger 152. The pair of tabs 194 disengage from the stop surfaces 176 and move through an arc movement away from the stop surfaces 176 when the trigger 152 is moved from the charge position relative to the sprayer housing 154 toward the discharge position of the trigger relative to the sprayer housing. The tabs 194 are positioned to engage against the stop surfaces 176 as the trigger 154 is pivoted to its forward, charge position. The engagement of the tabs with the stop surfaces 176 prevents further forward movement of the trigger toward the nozzle assembly 196. This prevents the trigger 152 from pushing against the nozzle assembly 196 and potentially pushing the nozzle assembly 196 off the sprayer housing 154.

Although the trigger sprayer of the invention has been described above by reference to a specific embodiment, it should be understood that modifications and variations could be made to the trigger sprayer without departing from the intended scope of the following claims.

The invention claimed is:

1. A manually operated trigger sprayer comprising;

a sprayer housing having a pump chamber in the sprayer housing, a liquid inlet opening on the sprayer housing, a liquid supply passage extending through the sprayer housing communicating the liquid inlet opening with the pump chamber, a liquid outlet opening on the sprayer housing, the liquid outlet opening having a center axis defining an axial direction along the center axis, a liquid discharge passage extending through the sprayer housing communicating the liquid outlet opening with the pump chamber, and at least one stop surface on the sprayer housing;

a pump piston mounted in the pump chamber for reciprocating movement of the pump piston between charge and discharge positions of the pump piston relative to the pump chamber; and a trigger operatively connected to the pump piston and mounted on the sprayer housing for movement of the trigger between charge and discharge positions of the trigger relative to the sprayer housing with the pump piston being moved between the respective charge and discharge positions of the pump piston in the pump chamber, the trigger having at least one pivot post on the trigger that mounts the trigger on the sprayer housing for pivoting movement of the trigger about the pivot post, and the trigger having a tab on the trigger that moves through an arc of movement in response to pivoting movement of the trigger and is positioned on the trigger to engage against the stop surface on the sprayer housing when the trigger is moved to the charge position of the trigger relative to the sprayer housing, and to disengage and move away from the stop surface when the trigger is moved from the charge position toward the discharge position of the trigger relative to the sprayer housing.

2. The trigger sprayer of claim 1, further comprising:

the sprayer housing having a socket hole; and, the trigger pivot post engages in the socket hole in mounting the trigger to the sprayer housing.

3. The trigger sprayer of claim 2, further comprising:

the stop surface is positioned adjacent the socket hole.

4. The trigger sprayer of claim 2, further comprising:

the stop surface is positioned in a plane that is tangent to the socket hole.

5. The trigger sprayer of claim 1, further comprising:

the tab projects from the pivot post.

6. The trigger sprayer of claim 5, further comprising:

the tab projects in the axial direction.

7. The trigger sprayer of claim 1, further comprising:

the sprayer housing having a socket hole;

the stop surface is positioned on the sprayer housing adjacent the socket hole;

the trigger pivot post engages in the socket hole in mounting the trigger to the sprayer housing; and the tab projects from the pivot post adjacent the stop surface.

8. A manually operated trigger sprayer comprising:

a sprayer housing having a pump chamber in the sprayer housing, a liquid inlet opening on the sprayer housing, a liquid supply passage extending through the sprayer housing communicating the liquid inlet opening with the pump chamber, a liquid outlet opening on the sprayer housing, the liquid outlet opening having a center axis defining an axial direction along the center axis, a liquid discharge passage extending through the sprayer housing communicating the liquid outlet opening with the pump chamber, a pair of socket holes on the sprayer housing on opposite sides of the liquid outlet opening center axis, and a pair of stop surfaces on the sprayer housing that extend from the pair of socket holes on opposite sides of the liquid outlet opening center axis;

a pump piston mounted in the pump chamber for reciprocating movement of the pump piston along the axial direction between charge and discharge positions of the pump piston relative to the pump chamber; and a trigger operatively connected to the pump piston and mounted on the sprayer housing for movement of the trigger between charge and discharge positions of the trigger relative to the sprayer housing with the pump piston being moved between the respective charge and discharge positions of the pump piston in the pump chamber, the trigger having a pair of pivot posts that extend into the pair of socket holes on the sprayer housing and thereby mount the trigger on the sprayer housing for pivoting movement of the trigger about the pivot posts, and the trigger having a pair of tabs that project from the pair of pivot posts and are positioned to engage against the pair of stop surfaces on the sprayer housing when the trigger is moved to the charge position of the trigger relative to the sprayer housing, and to disengage and move and move away from the pair of stop surfaces when the trigger is moved from the charge position toward the discharge position of the trigger relative to the sprayer housing.

9. the trigger sprayer of claim 8, further comprising:

the pair of stop surfaces on the sprayer housing being coplanar and extending in the axial direction.

10. The trigger sprayer of claim 8, further comprising:

the pair of tabs projecting from the pair of pivot posts in the axial direction adjacent the pair of stop surfaces.

11. The trigger sprayer of claim 8, further comprising:

the pair of socket holes, the pair of stop surfaces, the pair of pivot posts, and the pair of tabs all being positioned on an opposite side of the liquid outlet opening center axis from the pump chamber.

12. The trigger sprayer of claim 8, further comprising:

the pair of pivot posts being positioned between the pair of tabs.

13. A manually operated trigger sprayer comprising:

a sprayer housing having a pump chamber in the sprayer housing, a liquid inlet opening on the sprayer housing, a liquid supply passage extending through the sprayer housing communicating the liquid inlet opening with the pump chamber, a liquid outlet opening on the sprayer housing, the liquid outlet opening having a center axis defining an axial direction along the center axis, a liquid discharge passage extending through the sprayer housing communicating the liquid outlet opening with the pump chamber, a pair of socket holes on the sprayer housing on opposite sides of the liquid outlet opening center axis, and a pair of stop surfaces on the sprayer housing on opposite sides of the liquid outlet opening center axis;

a pump piston mounted in the pump chamber for reciprocating movement of the pump piston along the axial direction between charge and discharge positions of the pump piston relative to the pump chambers; and a trigger operatively connected to the pump piston and mounted on the sprayer housing for movement of the trigger between charge and discharge positions of the trigger relative to the sprayer with the pump piston being moved between the respective charge and discharge positions of the pump piston in the pump chamber, the trigger having a finger engagement surface that is positioned to be engaged by fingers of a hand holding the trigger sprayer, the trigger having a pair of arms that project from the finger engagement surface to distal ends of the pair of arms, the arms having pivot posts at the arm distal ends that project from the arms into the pair of socket holes on the sprayer housing and thereby mount the trigger on the sprayer housing for pivoting movement of the trigger about the pivot posts, and the trigger having a pair of tabs that project from the pair of arms and are positioned to engage against the pair of stop surfaces on the sprayer housing when the trigger is moved to the charge position of the trigger relative to the sprayer housing, and to disengage and move away from the pair of stop surfaces when the trigger is moved from the charge position toward the discharge position of the trigger relative to the sprayer housing.

14. The trigger sprayer of claim 13, further comprising:

the pair of stop surfaces on the sprayer housing being coplanar and extending in the axial direction.

15. The trigger sprayer of claim 13, further comprising:

the pair of tabs projecting from the pair of pivot posts in the axial direction adjacent the pair of stop surfaces.

16. The trigger sprayer of claim 13, further comprising:

the pair of socket holes, the pair of stop surfaces, the pair of pivot posts, and the pair of tabs all being positioned on an opposite side of the liquid outlet opening center axis from the pump chamber.

17. The trigger sprayer of claim 13, further comprising:

the pair of pivot posts being positioned between the pair of tabs.

18. A manually operated trigger sprayer comprising:

a sprayer housing having a pump chamber in the sprayer housing, a liquid inlet opening on the sprayer housing, a liquid supply passage extending through the sprayer housing communicating the liquid inlet opening with the pump chamber, a liquid outlet opening on the sprayer housing, the liquid outlet opening having a center axis defining an axial direction along the center axis, a liquid discharge passage extending through the sprayer housing communicating the liquid outlet opening with the pump chamber, a pair of pivot surfaces on the sprayer housing on opposite sides of the liquid outlet opening center axis, and a pair of stop surfaces on the sprayer housing extending in the axial direction from the pair of pivot surfaces on opposite sides of the liquid outlet opening center axis;

a pump piston mounted in the pump chamber for reciprocating movement of the pump piston along the axial direction between charge and discharge positions of the pump piston relative to the pump chamber; and a trigger operatively connected to the pump piston and mounted on the sprayer housing for movement of the trigger between charge and discharge positions of the trigger relative to the sprayer housing with the pump piston being moved between the respective charge and discharge positions of the pump piston in the pump chamber, the trigger having a finger engagement surface that is positioned to be engaged by fingers of a hand holding the trigger, the trigger having a pair of arms that project from the finger engagement surface to distal ends of the pair of arms, the arms having pivot posts at the arm distal ends that project from the arms and engage with the pair of pivot surfaces on the sprayer housing and thereby mount the trigger on the sprayer housing for pivoting movement of the trigger about the pivot posts, and the trigger having a pair of tabs that project in the axial direction from the pair of pivot posts and are positioned to engage against the pair of stop surfaces on the sprayer housing when the trigger is moved to the charge position of the trigger relative to the sprayer housing, and to disengage and move away from the pair of stop surface when the trigger is moved from the charge position toward the discharge position of the trigger relative to the sprayer housing.

19. The trigger sprayer of claim 18, further comprising;

the pair of trigger arms extend across opposite sides of the liquid outlet opening center axis.

20. The trigger sprayer of claim 18, further comprising:

the pair of posts being positioned between the pair of arms.

21. The trigger sprayer of claim 18, further comprising:

the pair of posts being positioned between the pair of tabs.

22. The trigger sprayer of claim 18, further comprising:

a pair of socket holes in the sprayer housing with the pair of pivot surfaces extending along the pair of socket holes.

23. The trigger sprayer of claim 22, further comprising:

the pair of pivot posts extending into the pair of socket holes.

24. The trigger sprayer of claim 18, further comprising:

the pair of socket holes, the pair of stop surfaces, and the pair of pivot posts, and the pair of tabs all being positioned on an opposite side of the liquid outlet opening center axis from the pump chamber.

* * * * *